US005408902A

United States Patent [19]

Burnett

[11] Patent Number: 5,408,902

[45] Date of Patent: Apr. 25, 1995

[54] COMPOSITE PERCUSSIVE TOOL

[76] Inventor: John A. Burnett, 39940 N. Bartlett La., Wadsworth, Ill. 60083

[21] Appl. No.: 209,555

[22] Filed: Mar. 10, 1994

[51] Int. Cl.[6] ..... B25D 1/12

[52] U.S. Cl. ..... 81/22; 81/20; 30/308.1

[58] Field of Search ..... 81/20, 22, 26; 30/308.1

[56] References Cited

U.S. PATENT DOCUMENTS

| | | | |
|---|---|---|---|
| 1,045,145 | 11/1912 | Hubbard | 81/22 |
| 1,501,095 | 7/1924 | Brock . | |
| 2,604,914 | 7/1952 | Kahlen . | |
| 2,928,444 | 3/1960 | Ivins | 81/22 |
| 2,940,492 | 6/1960 | Curry et al. . | |
| 3,704,734 | 12/1972 | Soto et al. . | |
| 4,697,481 | 10/1987 | Maeda . | |
| 5,012,702 | 5/1991 | Taylor . | |

FOREIGN PATENT DOCUMENTS

| | | |
|---|---|---|
| 1137125 | 11/1955 | France . |
| 1273449 | 3/1966 | Germany . |
| 4206588A1 | 3/1992 | Germany . |

*Primary Examiner*—James G. Smith
*Attorney, Agent, or Firm*—Rudnick & Wolfe

[57] ABSTRACT

A composite split head percussive tool including a rigid load bearing framework which carries a non-load bearing head assembly. The non-load bearing head assembly comprises a pair of axially aligned split heads that are interconnected to each other by an elastomeric link. The elastomeric link is encased and fixed within the tool body. During use of the tool, the elastomeric link acts as a dampener that suppresses the struck end rebound of the tool. When one head is struck against a surface, the elastomeric link allows the unstruck head to move toward the struck head and provide a secondary blow that inhibits the tool's struck end from bouncing away from the surface thereby providing the hammer with a unique "dead-blow" characteristic.

20 Claims, 2 Drawing Sheets

COMPOSITE PERCUSSIVE TOOL

FIELD OF THE INVENTION

The present invention generally relates to percussive tools and, more particularly, to a composite percussive tool such as a split head hammer which suppresses rebound when the tool is struck against a surface.

BACKGROUND OF THE INVENTION

When a percussive tool such as a hammer is moved to strike a surface of an object, part of the kinetic energy developed is utilized in doing the desired work on the object, part is dissipated as heat, and part is converted into potential energy in the form of distortion in the striking surface of the hammer. Hammer recoil has been encountered with hammer configurations including either exposed striking heads or a skeletal hammer design wherein the hammer heads are wholly received in an encasing to prevent sparking or the like during hammer use. The distortion of the striking surface of the hammer has potential energy much the same way as a compressed spring. It is this potential energy that causes the hammer to recoil or bounce back from the surface of the object being struck.

If a force is applied to the tool or hammer at the same time that the recoil would normally take place, and which force is equal and opposite to the potential energy, the two forces cancel each other and the energy is converted to heat. The cancellation of the two forces provides the hammer with an advantageous "dead-blow" characteristic.

Various attempts have been made to apply a force sufficient to prevent recoil in hammers and other striking articles. One attempt involves placing a slidable slug behind the striking head on the hammer. Alternatively, some hammers are designed with a powdered shot filled cavity in a head portion of the hammer. Such attempts have not, however, been completely successful in preventing recoil of the hammer from the surface of the object being struck.

Those hammers having slidable slugs arranged behind the striking head have not been very successful. During use of such hammers or tools, the slugs themselves develop potential energy when the hammer impacts against a surface of an object being struck and tend to recoil thus causing undesirable vibration or oscillation in the hammer.

The concept of using powdered shot material in a chamber defined in the head area of the hammer likewise has problems associated therewith. The required size of the chamber for holding a sufficient amount of powdered shot material and, thus, the size of the hammer is often out of proportion for a particular weight of the hammer. Moreover, unless a specific mixture of powdered shot material is utilized, the powdered material is often not very helpful in reducing the rebound of the hammer from that surface being struck.

It has been a prevalent practice in the trade to construct hammers with wooden handles. Recently, however, hammers having an internal metal skeleton surrounded by a molded cosmetic plastic body have become increasingly popular. The internal metal skeleton provides the hammer with stiffness and strength while the surrounding plastic body provides the desired aesthetic features for the hammer. A severe drawback with this design, however, is that the impact at the striking moment is transmitted through the metal handle core to the users hand, thus increasing efforts and labor of the user and thereby reducing the operating efficiency of the hammer.

While using a hammer, it is not unusual to miss the object to be struck with the head of the tool. Accordingly, impact forces are directed against the handle portion of the tool. The aesthetic plastic body surrounding the internal metal skeleton is not commonly designed for such impacts and is often damaged from such "overstrikes" of the hammer. Although damage to the handle portion of the tool from any single overstrike of the hammer may be slight, an accumulation of overstrikes directed against the plastic handle portion of the tool can result in significant damages to the hammer.

Thus there is both a need and a desire for a percussive tool which provides a so called "dead-blow" characteristic by preventing rebounding of the striking head on the hammer and which reduces the impact transmitted through the tool to the user thereof. A need and a desire furthermore exists for a composite hammer design including a plastic body but which has increased overstrike strength in the handle portion of the tool.

SUMMARY OF THE INVENTION

In view of the above, and in accordance with the present invention, there is provided a composite split head percussive tool that is structured in reverse order from that previously known in the industry. That is, the tool of the present invention is a composite assembly including a non-load beating internal head assembly carried by a rigid outer load bearing framework that provides strength and stiffness to the tool.

The head assembly of the tool includes a pair of axially aligned split heads which are connected to each other by an elastomeric link. Depending on the tool design, the heads of the head assembly can either be completely enclosed within the rigid framework of the tool or the heads may extend from opposite ends of the tool. In either form, the elastomeric link is fixedly held within the rigid framework and acts as a dampener that suppresses the struck end rebound of the tool. That is, when one head of the tool is struck against a surface, the elastomeric link allows the unstruck head to move toward the struck head to provide a secondary blow that inhibits the tool 's struck end from bouncing from the surface and with the elastomeric link drawing out the counterblow normally associated with the tool.

In a most preferred form, the percussive tool of the present invention is configured as a composite split head hammer with a generally T-shaped substantially rigid outer body configured with a head portion and a handle portion. A head assembly is provided at the head portion of the hammer body. The head assembly includes a first head and a second head. The second head is generally aligned with but spaced from the first head. An elastomeric link is arranged in a generally perpendicular relationship relative to the handle portion of the body and links inner ends of the heads to each other and acts as a dampener for suppressing the struck end rebound of the hammer. The elastomeric link is preferably fabricated from a urethane type material preferably ranging between about a 70 and about a 95 Shore A hardness The hammer body is preferably molded from a suitable plastic material. In a preferred form of the invention, the plastic material has glass, kevlar, carbon or other suitable fiber-like strands running therethrough to provide stiffness and strength to the hammer configuration. The hammer body is molded about the head assembly to maintain at least the elastomeric link contained within the molded hammer body.

In one form of the invention, the handle portion of the hammer is provided with a light weight non-load bearing handle core which extends in a longitudinal direction of the handle portion of the hammer in a generally perpendicular relationship with the elastomeric link. The purpose of the handle core is to provide shape and form to the handle portion of the hammer body.

In a preferred form of the invention, the handle core is formed from a polyurethane material. The polyurethane handle core is encased in the substantially rigid handle portion of the tool's outer body.

To increase the overstrike strength of the hammer, a pair of metal dowels are carried by and arranged on opposite sides of the handle portion of the hammer. The dowels are arranged on those sides of the handle portion corresponding to those sides of the hammer to which the hammer heads extend. The metal dowels extend generally normal to and away from the head portion of the hammer and are exteriorally exposed to the sides of and extend along a relatively short lengthwise portion of the handle portion of the hammer. In the illustrated embodiment of the invention, the dowels are arranged in combination with and are captively held in place by suitable channel configurations provided along the sides of the urethane handle core. The metal dowels serve to transfer overstrike impacts directed against the handle portion of the tool internally to the handle core. The transfer of impact forces to the handle core wants to cause expansion of the urethane core. The fiber-like strands in the outer plastic body encasing the handle core have high tension strength, however, and serve to contain the expansion of the urethane core thereby improving the overstrike strength of the hammer.

With the present invention, the elastomeric link of the tool's head assembly joins the split heads and replaces the shot charge or sliding slugs of heretofore known tool designs. When one head of the tool is struck against the surface, the elastomeric link allows the unstruck end of the tool to act as a lagging mass and provides a secondary blow that keeps the struck head from bouncing from the surface being struck and thus, advantageously provides a "dead-blow" characteristic to the tool. Depending on the hardness of the urethane material used to form the elastomeric link and the weight distribution between the heads, the spacing between the heads is preferably sized such that an innermost end of tool's unstruck head is permitted to collide with the innermost end of the tool's struck head thereby enhancing the "dead-blow" characteristic of the composite tool. The counterblow in the tool is drawn out in time by the elastomeric link. Moreover, in those tools configured as a hammer, the handle portion of the tool is highly damped due to the hysterisis of the composite and lack of a steel handle core extending along the length of the tool. It has been found that the vibrations normally felt in the handle are not discernable with a hammer designed according to the present invention.

These and other numerous objects, aims, and advantages of the present invention will become readily apparent from the following detailed description of the invention, the appended claims and the accompanying drawings.

DETAILED DESCRIPTION OF A PREFERRED EMBODIMENT

Figure 1:
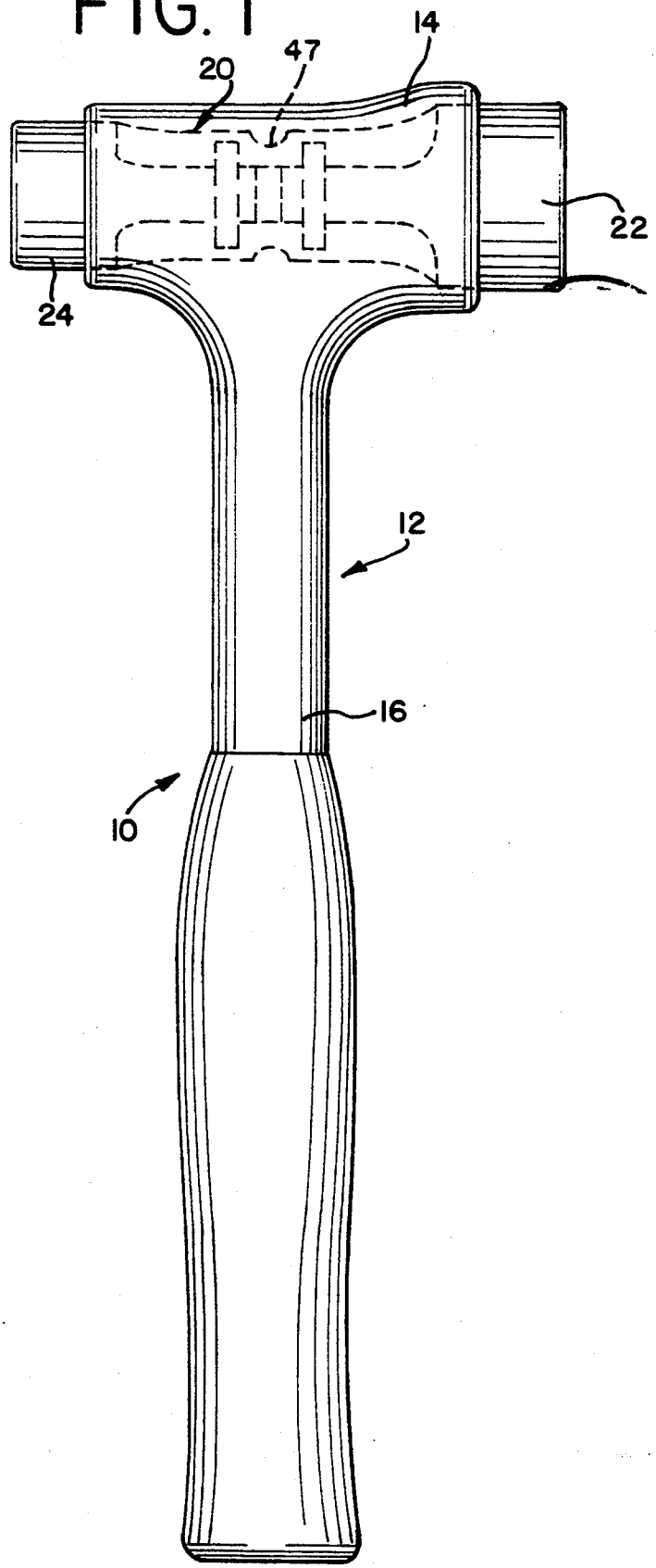
FIG. 1 is a side elevational view of a percussive tool of the present invention schematically illustrated in the form of a hammer.

While the present invention is susceptible of embodiment in various forms, there is shown in the drawings and will hereinafter be described various preferred embodiments of the invention with the understanding that the present disclosure is to be considered as setting forth exemplifications of the invention which are not intended to limit the invention to the specific embodiments illustrated.

Figure 2:
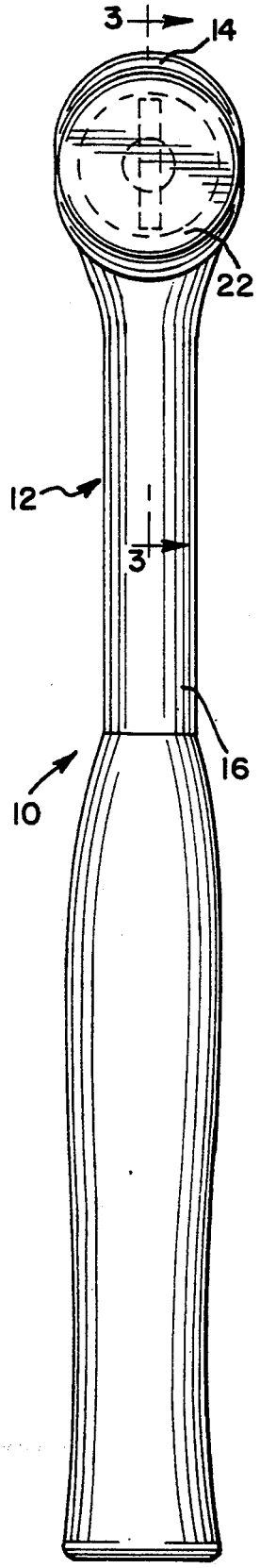
FIG. 2 is a front elevational view of the tool of the present invention.

Referring now to the drawings, wherein like reference numerals refer to like parts throughout the several views, there is shown in FIGS. 1 and 2 a percussive tool 10 constructed in accordance with the present invention. The tool of the present invention is exemplified for purposes of this disclosure as being in the form of a hammer having exposed striking heads. It should be appreciated, however, that the present invention is equally applicable to other forms of percussive tools other than that shown wherein the heads of the tool may be suitably encased in an outer body of the tool.

Figure 3:
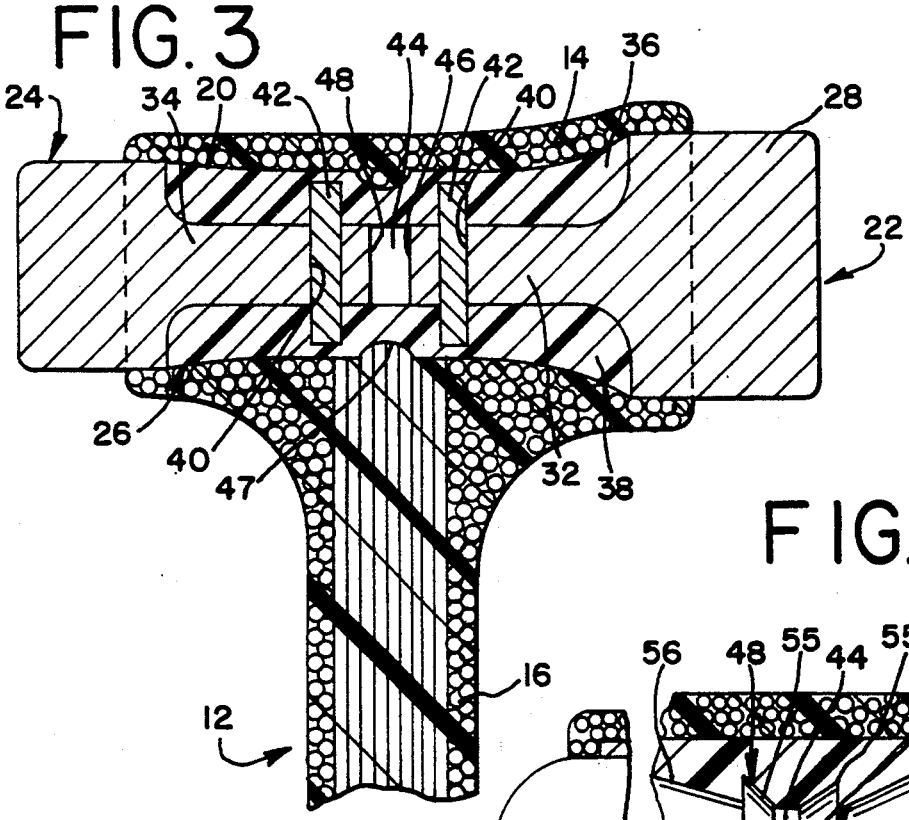
FIG. 3 is a fragmentary longitudinal sectional view taken along line 3—3 of FIG. 2.

As shown, the hammer 10 is comprised of a generally T-shaped and substantially rigid load bearing outer body 12 configured with a head portion 14 that is joined to a handle portion 16. As shown in FIG. 3, a salient feature of the present invention concerns the provision of a non-load bearing head assembly 20 provided at the head portion 14 of the body 12. The head assembly 20 includes first and second axially aligned and spaced apart heads 22 and 24 extending toward first and second sides, respectively, of the hammer. The heads 22, 24 are connected to each other by an axially elongated elastomeric link 26 fixedly maintained within the body 12 of the tool.

Heads 22, 24 are preferably fabricated from a suitable metal or metal alloy. In a most preferred form, each head 22, 24 is fabricated from a 4140 steel. In the illustrated embodiment, head 22 defines an enlarged head portion 28 while head 24 defines an enlarged head portion 30. In the preferred embodiment, head 22 has an integral shank portion 32 extending away from the head portion 28. Similarly, head 24 has an integral shank portion 34 extending away from the head portion 30. As will be appreciated, the configuration of the striking heads can be other than that shown without departing from the spirit and true scope of the present invention.

In illustrated embodiment, the elastomeric link 26 is configured to receive and hold inner ends of the heads 22, 24. Notably, the elastomeric link 26 is formed from a polyurethane material which ranges between about a 70 and about a 95 Shore A hardness. In a most preferred form, the elastomeric link is formed from a polyurethane material having about an 90 Shore A hardness. The elastomeric link 26 preferably includes a pair of complimentary split supports 36 and 38. The supports 36, 38 can be split lengthwise between the striking heads 22, 24 and vertically to facilitate molding of the supports. The supports 36, 38 preferably have a symmetrical configuration relative to each other such that a one-cavity die can be used to mold both supports.

Although they are axially spaced from each other, the inner ends of the split striking heads 22, 24 are connected to each other through the elastomeric link 26. In the embodiment illustrated in FIG. 3, the shanks 32, 34 of the heads 22, 24, respectively, are each provided with a bore 40 extending transversely therethrough. A pin 42, preferably formed from steel or other suitable material having a relatively high shear strength, passes through the bore 40. Opposite ends of each pin 42 radially extend from the respective shank and are fixedly received within the elastomeric link 26 thus maintaining the respective head in association with the elastomeric link 26. In addition to the pins 42, either one or both of the shanks 32, 34 may be adhesively secured to the elastomeric link 26.

In a most preferred from of the invention, the head assembly 20 is configured such that a gap or spacing 44 of predetermined size separates confronting faces 46, 48 defined on the innermost ends of the shanks 32, 34, respectively. The size of the gap 44 is determined by the durometer hardness of the material forming the elastomeric link 26 and the weight distribution between the heads 22, 24. As will be appreciated, elastomeric links formed from materials having a relatively high durometer hardness will size the gap 44 smaller than those elastomeric links formed from softer materials having a relatively low durometer hardness. As shown, the gap or spacing 44 is preferably devoid of those materials used to form the elastomeric link 26. Alternatively, a readily collapsible foam or other suitable material can be provided in the space 44 as long as such material does not interfere with movement of the heads 22, 24 toward each other.

The rigid load bearing body 12 of the tool 10 can be formed using any of a variety of different well known techniques. If it is possible to obtain the desired properties, the rigid outer framework or body 12 of the composite tool 10 is preferably formed using a conventional injection molding technique. Alternatively, however, it is possible to form the framework or body 12 by using a conventional wet wrapping technique or a conventional dry wrapping technique. Whatever method is used to form the framework or body 12, and as mentioned, the heads 22, 24 of the head assembly 20 can be completely encased, partially encased, or totally extending beyond the body 12 of the composite tool without detracting or departing from the scope of the present invention.

A preferred method or technique for forming the framework or body 12 involves appropriately positioning the non-load bearing head assembly 20 within a mold and thereafter molding a suitable thermosetting plastic or resin material thereabout to at least partially encase the head assembly 20 within a molded body 12. In a hammer design, the outer molded body 12 of the composite tool includes the head portion 14 and the handle portion 16. The head portion 14 of the molded body 12 at least partially encases the head assembly 20 thereby maintaining the elastomeric link 26 therewithin. With this technique, a roving material including fiberglass, kevlar or other suitable fiber material is initially wrapped about the head assembly 20 and then plastic material is molded thereabout. Alternatively, a plastic material having reinforcing fibers may be injection molded about the internal head assembly 20 to form the rigid outer framework for the tool.

The wet wrapping technique for forming the load bearing tool body 12 includes encasing at least the elastomeric member 26 of the non-load bearing head assembly 20 in a wetted glass epoxy or resin material of the type sold by Adtech Plastics as CER-112 including a suitable fabric or roving of glass filled material fibers. The wetted material is wrapped about the link 26 and shaped to provide the desirable configuration for the tool. In those designs wherein the elastomeric link 26 includes supports 36, 38, wrapping the wetted fabric about the supports promotes the integrity of the elastomeric link while providing strength, stiffness, and load bearing capacity to the body 12 of the composite tool 10. The wet wrapping forming the body of the composite tool is then subjected to appropriate curing and setting conditions, such as elevated temperatures within a cure oven to allow the wet wrapping to reach the desired solid state.

The dry wrapping technique for forming the load bearing tool body 12 includes wrapping the non-load bearing head assembly 20 of the tool in a roving material such as dry fiberglass, kevlar, or carbon fibers. As discussed above, in those designs wherein the elastomeric link 26 includes split supports 36, 38, the roving surrounding the supports promotes the integrity thereof. The wrapped assembly is then subjected to a conventional resin transfer molding technique. In the present invention, the resin material used to impregnate the fibers at least partially encasing the head assembly 20 and forming the body 12 of the tool 10 includes, ideally, the type sold by Adtech Plastics as CER-112. Following impregnation with resin material, the tool is subjected to appropriate curing or setting conditions in a manner well known in the art.

As shown in FIG. 3, the elastomeric link 26 is preferably provided intermediate opposite ends thereof with a suitably shaped detent or annular groove 47 at the outer surface thereof. When the material for the body 12 of the tool is formed about the head assembly 20, a portion of the material forming the body 12 of the composite tool extends into the groove or detent 46 thereby holding and preventing separation of the head assembly 20 including the heads 22, 24 from the body of the tool 10.

Figure 4:
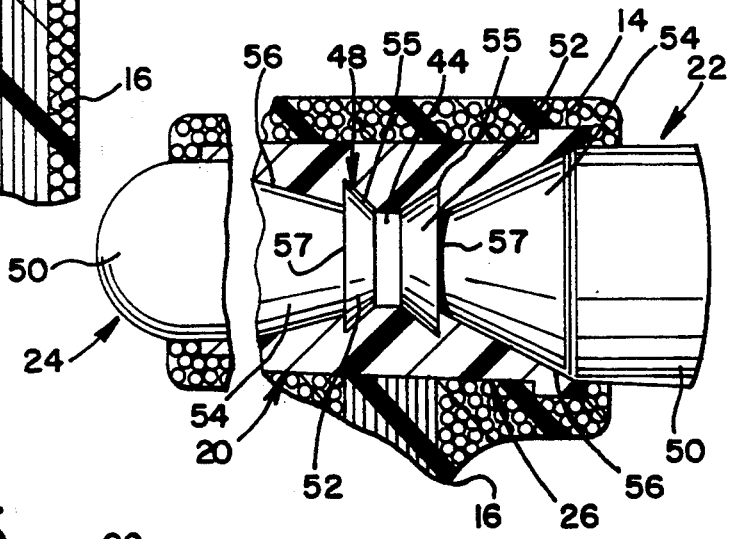
FIG. 4 is a fragmentary sectional view of an alternative form of construction of the present invention.

Turning to FIG. 4, there is schematically illustrated an alternative embodiment for the head assembly 20. In this form of the invention, the split heads 22, 24 are maintained in operative association with the elastomeric link 26 in a different manner than that illustrated in FIG. 3. In this alternative embodiment, the shank of each head is configured with a radial shoulder or flange 48 arranged along the length of the respective shank. Each shoulder 48 extends generally normal to and outwardly from the shank of the respective striking head. In this embodiment, the elastomeric link 26 completely encases the shoulder 48 of each head and thereby properly positions the heads while maintaining them in working association with the elastomeric link 26. In the same manner described above, the innermost ends of the shanks 32, 34 of the respective heads 22, 24 have a predetermined size gap or space 44 therebetween.

In a most preferred from of the invention, and as shown in FIG. 4, each head 22, 24 is provided with a head portion 50 provided toward an outer end of the respective head, a flange or shoulder portion 52 provided at an inner end of the respective head, and a tapered shank portion 54 joining the head portion 50 and the flange or shoulder portion 54. In this form of the invention, the outer surface 55 of the flange portion 52 on each head 22, 24 has a frustoconically shaped or tapering outer surface which angles toward the inner face of the respective head. Moreover, the tapering outer surface 56 on the shank portion 52 of each head 22, 24 is preferably configured such that the diameter of the shank portion 54 at that end connected to the head portion 50 is substantially the same diameter as the head portion 50 while the diameter of the shank portion 54 at that end connected to the flange or shoulder portion 52 of the respective head has a smaller diameter than the maximum diameter of the flange or shoulder portion 52. Accordingly, a radial step or shoulder 57 is defined between the flange and shank portions 52 and 54, respectively, of each head 22, 24. In the embodiment illustrated in FIG. 4, the elastomeric link 26 surrounds and encases at least the flange and shank portions 52 and 54, respectively, of each head. As will be appreciated, the step 57 maintains each head in working association with the elastomeric link 26.

The tapering outer configurations on the flange portion 52 and shank portion 54 of each head 22, 24 serves to distribute the forces directed against the heads 22, 24 both axially and outwardly into the elongated elastomeric link 26. The tapering configuration on the flange portion 52 and the tapering configuration on the shank portion 54 of each head may vary as a function of the head configuration. In the illustrated embodiment, the tapered configuration on the outer surface 55 of the flange portion 52 of head 22 defines an angle of about 30° relative to the longitudinal axis of head 22. Whereas, the tapering configuration on the outer surface 56 of the shank portion 54 of head 22 measures about 17° relative to the longitudinal axis of head 22. The tapered configuration on the outer surface 55 of the flange portion 52 of head 24 measures about 25° relative to the longitudinal axis of head 24. Whereas, the tapered configuration on the outer surface 56 of the shank portion 54 of head 24 measures about 11° relative to the longitudinal axis of head 24.

Figure 5:
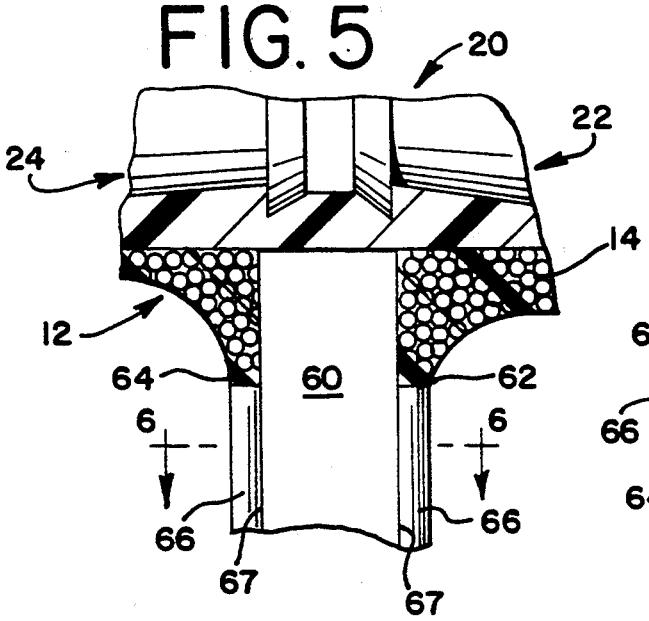
FIG. 5 is a fragmentary sectional view of another alternative form of construction of the present invention.

As an alternative arrangement, and as shown in FIG. 5, the hammer 10 can further include a handle core 60. Unlike prior devices, however, the handle core 60 is specifically designed as a lightweight non-load bearing member which extends generally perpendicular to the longitudinal axis of the elastomeric link 26. The handle core 60 extends within the handle portion 16 of body 12 in a longitudinal direction of the handle portion 16. In a most preferred form of the invention, the handle core 60 is comprised of a polyurethane material having a relatively high durometer hardness preferably in the range of about 95 Shore A hardness. Preferably, glass filled material roving of the type discussed above may be wrapped endwise along and about the handle core 60 and the head assembly 20. Alternatively, a woven sock could be arranged about the handle core 60 to create a handle load bearing layer. As shown, the handle core 60 is separate from the elastomeric link 26 of the head assembly 20. It is well within the scope of the present invention, however, to attach the handle core 60 to the link 26.

Figure 6:
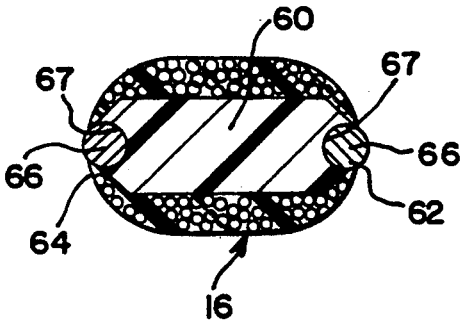
FIG. 6 is a sectional view taken along line 6—6 of FIG. 5.

As shown in FIGS. 5 and 6, the handle portion 16 of the tool 10 defines opposite and first and second opposed side surfaces 62 and 64 which are exposed to the first and second sides of the hammer. At least one metal, preferably steel, rod or dowel 66 is exteriorally exposed along a portion of the length of each side surface 62, 64 of the handle portion. One end of each steel dowel or rod 66 is arranged proximate to the head portion 14 of the tool with the dowel 66 extending lengthwise therefrom. In the illustrated embodiment, the handle core 60 is configured with elongated channels 67 extending along the sides thereof corresponding to the side surfaces 62. 64 of the handle portion 16. Each channel 67 in the handle core 60 is configured to captively receive and hold a respective one of said dowels 66 in place along the length of the handle portion 16 of the tool 10. It is to be understood that other devices for holding the dowels in place along the handle portion likewise remain within the scope of the present invention. The purpose of the dowels 66 is to transfer overstrike impacts directed against the handle portion 16 into the urethane handle core 60. The transfer of overstrike impacts to the urethane handle core 60 causes the handle core 60 to want to expand outwardly. The fiber-like strands in the outer body of the handle portion 16 surrounding the urethane core 60, however, have high tension strength and thereby contain the handle core 60 from expanding thereby improving the overstrike strength of the hammer.

The split head tool described above has several advantages over heretofore known tools. Unlike other percussive tools, the composite tool of the present invention has a strong, load bearing outer shell or framework 12 which surrounds a non-load bearing or flexible internal core 20. The inherent characteristic of the wrapping and resin mixture provides the desired shock dampening qualities. Notably, the handle portion 16 of the tool is devoid of any structural member which would normally transmit vibrations to the user of the tool. Instead, the handle portion 16 of the tool is specifically designed to minimize vibrations to the user.

The design of the present invention advantageously provides a unique "dead-blow" characteristic during use of the hammer. The elastomeric link 26 connects the otherwise split heads 22, 24 to each other such that the unstruck head of the tool acts as a lagging mass that suppresses the struck end rebound of the tool. That is, the elastomeric link 26 is specifically designed to allow a degree of movement between the heads 22, 24 such that when one head is impacted against a surface of an object, the second head moves toward the impacted head thereby providing a secondary blow that keeps the struck head from bouncing. To further enhance the "dead-blow" characteristic of the tool, the gap or space 44 between the innermost ends of the split heads is sized so that the innermost end of the unstruck head of the tool moves toward and collides with the innermost end of the struck head of the tool thereby deadening the blow of the tool. Wherein, the predetermined size of the gap or space 44 is determined as a function of the durometer hardness of the material used to from the elastomeric link 26 and the weight distribution of the heads 22, 24. Moreover, the elastomeric link 26 absorbs the potential energy or counterblow of the struck head over time. As such, the vibrations normally felt in the handle portion 16 of the tool are not discernable.

In those embodiments wherein the tool is configured with a generally T-shaped or hammer shape, the present design offers advantageous characteristics of high flexural strength and high impact resistance to overstrikes of the hammer. As should be appreciated, the dowels 66 arranged along opposite sides of the handle portion 16 serve to disperse the overstrike impacts directed against the handle core 60. Thus, the design of the present invention affords maximum resistance to breakage.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A composite hammer comprising:

a substantially rigid load bearing outer body configured with interconnected head and handle portions extending generally perpendicular relative to each other; and a non-load bearing head assembly carried by the head portion of said body and including first and second heads which are generally aligned with but separated from each other, and an elastomeric link arranged in a generally perpendicular relationship relative to the handle portion and fixed within the head portion of the body for linking the heads to each other and to act as a dampener to suppress the struck end rebound of the hammer.

2. The composite hammer according to claim 1 said body is molded from a rigid thermosetting resin material.

3. The composite hammer according to claim 1 wherein said elastomeric link comprises split elastomeric supports which receive and hold inner ends of the striking heads therebetween.

4. The composite hammer according to claim 1 wherein said body includes roving which is secured about the split supports for holding the supports in non-releasable association to each other and for providing stiffness to the elastomeric link.

5. The composite hammer according to claim 1 wherein said elastomeric link is formed from a urethane type material ranging between about a 70 and about a 95 Shore A hardness.

6. A composite split head percussive tool comprising:

a substantially rigid body foraged from a plastic material;

a pair of axially aligned and spaced metal striking heads at least partially accommodated within within said body: and an axially elongated elastomeric link fixedly arranged within said body for connecting the striking heads in axially spaced relation relative to each other so as to allow a degree of movement between the heads when one head is impacted against a surface thereby suppressing struck end rebound of the tool.

7. The percussive tool according to claim 6 wherein said striking heads are fabricated from steel.

8. The percussive tool according to claim 6 wherein said elastomeric link is formed from a urethane material ranging between about a 70 and about a 95 Shore A hardness.

9. The percussive tool according to claim 6 wherein said elastomeric link is comprised of a plurality of supports which hold at least a portion of the heads therebetween.

10. The percussive tool according to claim 6 wherein said body is molded from a reinforced plastic material.

11. The percussive tool according to claim 6 wherein said body includes glass epoxy wrappings which at least partially encase said head assembly therewithin.

12. A composite split head hammer comprising:

a generally T-shaped substantially rigid body configured with a head portion and a handle portion;

a lightweight nonload bearing handle core accommodated within the handle portion of said body in a longitudinal direction of said handle portion; and a head assembly accommodated within the head portion of the body and which extends generally normal to the handle core, said head assembly comprising axially aligned and axially spaced striking heads and an elastomeric link for linking inner ends of the striking heads to each other to act as a dampener such that when one head is struck against a surface the unstruck head moves toward the struck head to provide a secondary blow that inhibits the struck end from bouncing from the surface and the counterblow is drawn out by the elastomeric link.

13. The composite hammer according to claim 12 wherein said body is formed from reinforced plastic materials including fibers which are wrapped along and about said head assembly for adding strength and stiffness to the elastomeric link.

14. The composite hammer according to claim 12 wherein said elastomeric link includes a plurality of elastomeric supports which surround and secure the inner ends of the striking heads therebetween.

15. The composite hammer according to claim 14 further including a glass filled material wrapped about the head assembly for holding the elastomeric supports in relation relative to each other and along and about a lengthwise portion of the handle core.

16. The composite hammer according to claim 12 wherein said head assembly further includes pins fixed in the elastomeric link and transversely extending through an inner end of each head thereby securing the heads to the elastomeric link.

17. A composite percussive tool comprising:

a non-load bearing internal assembly including a pair of axially aligned heads which are interconnected to each other by an elastomeric link so as to allow a degree of movement between the heads when one head impacts a surface thereby suppressing rebound of the tool; and a rigid load bearing outer framework which fixedly holds and carries said elastomeric link and at least partially surrounds the heads of said internal assembly to provide strength and rigidity to said tool.

18. The composite percussive tool according to claim 17 wherein the axially aligned heads each include a shank portion fixedly secured within the elastomeric link, and wherein confronting faces defined by the shank portions of the axially aligned heads are spaced apart by a predetermined distance.

19. A composite hammer comprising:

a rigid body configured with a head portion having first and second axially aligned heads extending toward first and second sides, respectively, of the hammer and an elongated handle portion extending generally normal to the head portion, said handle portion defining first and second side surfaces extending generally parallel to the first and second sides of said hammer and having a non-load bearing core extending along at least a lengthwise section of said handle portion and away from said head assembly, said body being formed from epoxy material including roving which is wrapped lengthwise along said handle portion, said handle portion further including pins at least partially exteriorally arranged and extending along the first and second side surfaces of said handle for transferring overstrike impact forces directed against said handle portion to the handle core.

20. The composite hammer according to claim 19 wherein said pins are fabricated from steel and are positioned along the length of the handle portion by the handle core such that one end of each pin is arranged proximate to the head portion of the hammer.

* * * * *